US011396754B2

(12) United States Patent
Luscombe

(10) Patent No.: US 11,396,754 B2
(45) Date of Patent: Jul. 26, 2022

(54) SYSTEM FOR SUPPORTING NON-STRUCTURAL BUILDING COMPONENTS

(71) Applicant: Polyplas International Pty Ltd., Rowville (AU)

(72) Inventor: Peter Luscombe, Rowville (AU)

(73) Assignee: Polyplas International Pty Ltd, Rowville (AU)

( * ) Notice: Subject to any disclaimer, the term of this patent is extended or adjusted under 35 U.S.C. 154(b) by 0 days.

(21) Appl. No.: 16/158,308

(22) Filed: Oct. 12, 2018

(65) Prior Publication Data

US 2019/0112816 A1 Apr. 18, 2019

(30) Foreign Application Priority Data

Oct. 12, 2017 (AU) ..... 2017904132

(51) Int. Cl.
*E04D 13/158* (2006.01)
*E04B 9/20* (2006.01)
(Continued)

(52) U.S. Cl.
CPC ..... *E04D 13/158* (2013.01); *E04B 9/006* (2013.01); *E04B 9/10* (2013.01); *E04B 9/20* (2013.01);
(Continued)

(58) Field of Classification Search
CPC . E04D 9/14; E04D 13/158; E04B 9/10; E04B 9/20; E04B 9/064; E04B 2009/186;
(Continued)

(56) References Cited

U.S. PATENT DOCUMENTS 1,244,465 A * 10/1917 Braly ..... F16L 3/14 248/61
2,024,961 A * 12/1935 Barge ..... E04B 9/18 52/346

(Continued)

FOREIGN PATENT DOCUMENTS

JP 2014152506 A 8/2014

*Primary Examiner* — Joshua K Ihezie
(74) *Attorney, Agent, or Firm* — EcoTech Law Group, P.C.

(57) ABSTRACT

A system for supporting a non-structural building component beneath a soffit of a building. The system has a plurality of suspension assemblies that each have a first elongate non-rigid member, and at least one second elongate non-rigid member. The first elongate non-rigid member is secured at an upper end to a structural portion of the building at a first location, and at a lower end to one of: the non-structural building component, or a support member to which the non-structural building component is secured. The second elongate non-rigid member that is secured at a lower end to one of: the non-structural building component, or the support member to which the non-structural building component is secured, and at an upper end to a structural portion of the building at a second location. The first elongate non-rigid member is oriented substantially vertically. The second location is horizontally spaced from the first location, such that the second elongate non-rigid member is inclined to vertical. When the building is in a stable condition, the tensile force in the first elongate non-rigid member is greater than the vertical component of the tensile force in the second elongate non-rigid member.

16 Claims, 10 Drawing Sheets

(51) Int. Cl.
*E04B 9/10* (2006.01)
*E04B 9/00* (2006.01)
*E04B 9/18* (2006.01)
*E04B 9/06* (2006.01)

(52) U.S. Cl.
CPC ..... *E04B 9/205* (2013.01); *E04B 9/064* (2013.01); *E04B 2009/186* (2013.01)

(58) Field of Classification Search
CPC . E04B 9/205; E04B 9/006; E04B 9/18; E04B 9/225; E04B 9/242; F24F 13/32; F24F 13/0254; F24F 13/02; F24F 2221/14; F21S 8/061; F21S 8/06
See application file for complete search history.

(56) References Cited

U.S. PATENT DOCUMENTS 2,523,180 A * 9/1950 Harold ..... F21S 8/06 248/342
3,403,702 A * 10/1968 Poole ..... F16L 55/04 138/37
3,842,561 A * 10/1974 Wong ..... E04B 9/18 52/506.07
4,358,817 A * 11/1982 Bielemeier ..... F21V 21/16 362/220
4,498,374 A * 2/1985 Gibson ..... F24F 13/32 454/204
4,787,592 A 11/1988 Aoshika
5,516,068 A * 5/1996 Rice ..... E04B 9/006 248/300
7,871,045 B2 * 1/2011 Moore ..... F16M 13/027 248/188.1
7,980,523 B2 * 7/2011 O'Neil ..... F24H 9/06 108/42
8,667,756 B1 * 3/2014 Sareyka ..... E04B 9/18 52/506.06
9,320,370 B1 * 4/2016 Bianchini ..... A47F 5/0892
9,347,587 B2 * 5/2016 Allivato, Sr. ..... F16L 3/1058
2003/0221296 A1 * 12/2003 Gijsel ..... F16L 3/137 24/298
2005/0189462 A1 * 9/2005 Berlyn ..... F24F 13/32 248/317
2008/0060285 A1 * 3/2008 Lefebvre ..... E04B 1/2403 52/149
2015/0345823 A1 * 12/2015 Pinkalla ..... F24F 13/0218 138/107
2017/0261129 A1 9/2017 Duggan
2019/0100914 A1 * 4/2019 Albartus ..... E04B 9/10

* cited by examiner

SYSTEM FOR SUPPORTING NON-STRUCTURAL BUILDING COMPONENTS

RELATED APPLICATION

This patent application claims priority to Australian Patent Application No. 2017904132, filed on Oct. 12, 2017, which has been incorporated herein in its entirety for all purposes.

FIELD OF THE INVENTION

The present invention relates to a system for supporting non-structural building components.

BACKGROUND

Non-structural building components are used in the functioning of many buildings to distribute building services, such as electrical power and data, water, gas, and ventilation and refrigeration. It is common for non-structural building components to be suspended beneath a soffit of the building. However, it will be appreciated that in some instances non-structural building components may additionally or alternatively need to be supported adjacent a vertical wall of the building.

It is known to support non-structural building components in an elevated position beneath a soffit using suspension hangers, each of which is a rigid threaded rod. The upper end of the suspension hanger is embedded in (or otherwise secured to) a soffit. The building service components are then secured to the lower end of the suspension hanger using internally threaded nuts, and other fastening components.

In some instances, it is important that buildings and the components are properly protected and will continue to operate after an event in which the building is subject to substantial shock and/or vibration. Such events include earthquakes and other seismic events, and commercial blasts. In these instances, the non-structural components need to be braced and/or isolated so as to receive minimal damage. In order to withstand such events, it is known to provide bracing to the non-structural building components, however the bracing puts compressive and bending loads on the suspension hanger. To prevent the suspension hangers collapsing, the threaded rods are then reinforced, which adds weight and complexity to the system. Further, installation of the system is more complicated and time consuming.

There is a need to address the above, and/or at least provide a useful alternative.

SUMMARY

There is provided a system for supporting a non-structural building component beneath a soffit of a building, the system having a plurality of suspension assemblies that each comprise:

a first elongate non-rigid member that is secured at an upper end to a structural portion of the building at a first location, and at a lower end to one of: the non-structural building component, or a support member to which the non-structural building component is secured; and at least one second elongate non-rigid member that is secured at a lower end to one of: the non-structural building component, or the support member to which the non-structural building component is secured, and at an upper end to a structural portion of the building at a second location, wherein:

the first elongate non-rigid member is oriented substantially vertically, the second location is horizontally spaced from the first location, such that the second elongate non-rigid member is inclined to vertical, and when the building is in a stable condition, the tensile force in the first elongate non-rigid member is greater than the vertical component of the tensile force in the second elongate non-rigid member.

Preferably, when the building is in a stable condition, substantially all of the vertical load of the non-structural building component is supported by the first elongate non-rigid members.

In some embodiments, each suspension assembly has two second elongate non-rigid members, and the upper ends of the two second elongate non-rigid members are secured to structural portion of the building at spaced apart second locations.

Preferably, each of the second elongate non-rigid members is provided with an adjuster that facilitates adjustment of the length of the respective second elongate non-rigid member between upper and lower ends. In some embodiments, the second elongate non-rigid members are flexible. In such embodiments, the adjuster can comprise a cleat.

Preferably, the system has pairs of the suspension assemblies that are arranged so that, within each pair, one of the second elongate non-rigid members of a first suspension assembly lies in vertical plane that is parallel to a vertical plane in which one of the second elongate non-rigid members of a second suspension assembly lies.

In embodiments in which each suspension assembly has a single second elongate non-rigid member, the pairs of suspension assemblies are preferably arranged so that tensile forces in the first elongate members, and the vertical components of the tensile forces in the second elongate non-rigid members are substantially coplanar.

In certain embodiments, each of the assemblies includes one or more dampers that are each configured to inhibit transmission of vibration to the building.

In some embodiments, the system can further comprise one or more support members to which the non-structural building component is secured, and wherein the lower ends of the first and second elongate non-rigid members in the suspension assemblies are secured to the support members. In one form, each support member can include a strut that extends transversely across each the non-structural building component, and opposing ends of the strut are each supported by a pair of the suspension assemblies. The struts can be positioned beneath the non-structural building component.

Each support member can include a strap member having two ends that are attached to the respective strut, and extends about the non-structural building component so as to secure the non-structural building component to the strut. Each support can further include one or more dampers that are each configured to inhibit transmission of vibration to the building.

In at least some alternative embodiments, the system includes tether members that are secured to the non-structural building component, and the lower ends of at least one of the first and second elongate non-rigid members in a respective one of the suspension assemblies is secured to each tether member. In some further alternative embodiments, the non-structural building component has integrally formed tether members, and the lower ends of at least one of the first and second elongate non-rigid members in a respective one of the suspension assemblies is secured to each tether member.

The present invention also provides a method for installing a system for supporting a non-structural building component beneath a soffit of a building, the method involving:

providing a plurality of suspension assemblies as previously described;

securing the upper end of a first elongate non-rigid building component to a structural portion of the building at a first location, the first location being selected such that, in the installed system, the first elongate non-rigid building component is oriented substantially vertically;

securing the upper end of at least one second elongate non-rigid building component to a structural portion of the building at a second location that is spaced horizontally spaced from first location;

securing the lower end of first elongate non-rigid building component to one of: the non-structural building component, or a support member to which the non-structural building component is secured;

securing the lower end of second elongate non-rigid building component to one of: the non-structural building component, or a support member to which the non-structural building component is secured, whereby in the installed system, the second elongate non-rigid member is inclined to vertical; and setting the tension in the second elongate non-rigid member such that the tensile force in the first elongate non-rigid member is greater than the vertical component of the tensile force in the second elongate non-rigid member.

BRIEF DESCRIPTION OF THE DRAWINGS

In order that the invention may be more easily understood, an embodiment will now be described, by way of example only, with reference to the accompanying drawings, in which.

DETAILED DESCRIPTION

Figure 1:
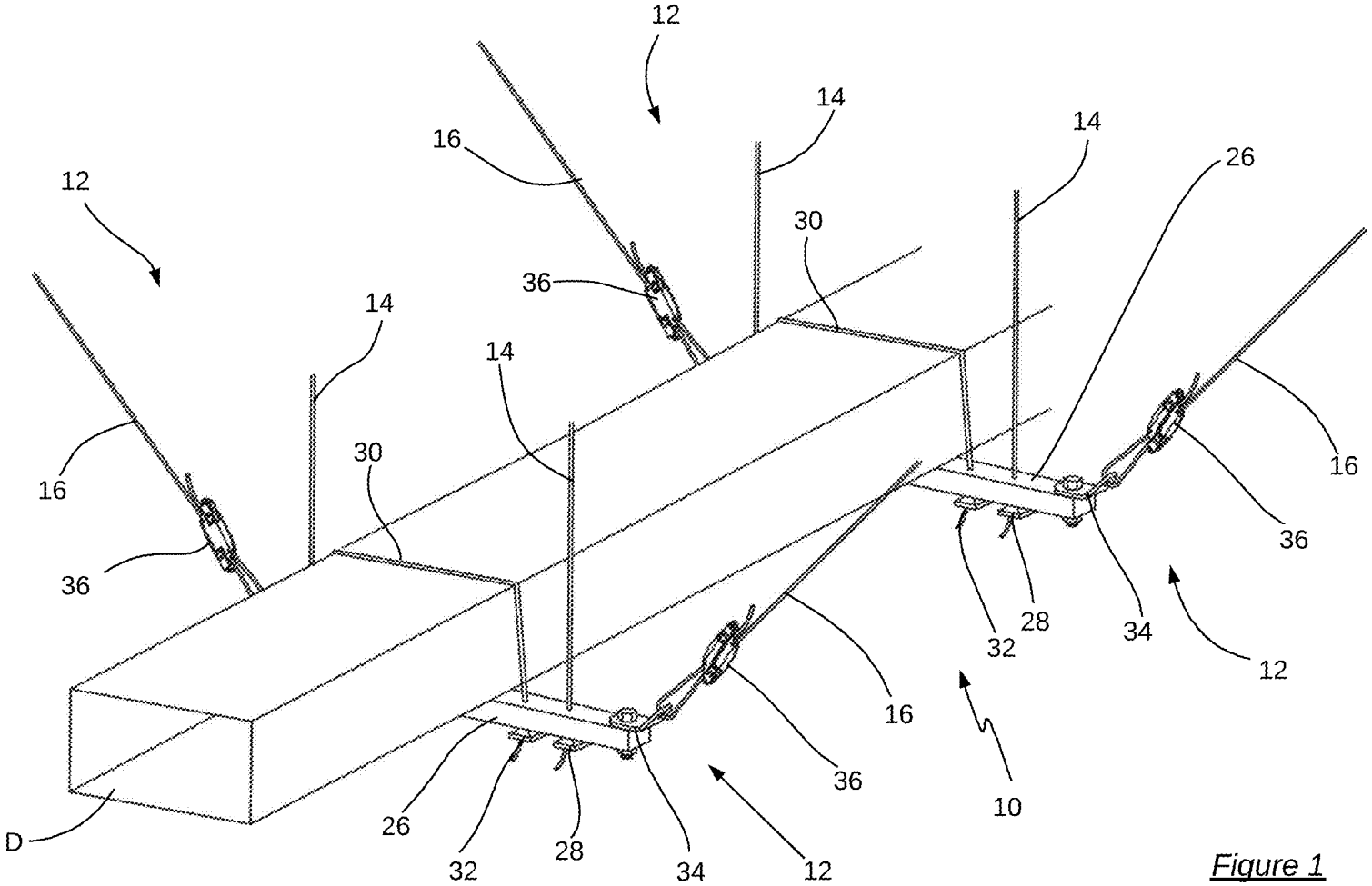
FIG. 1: is a perspective schematic view of a system for supporting non-structural building components according to a first embodiment of the present invention.
Figure 2:
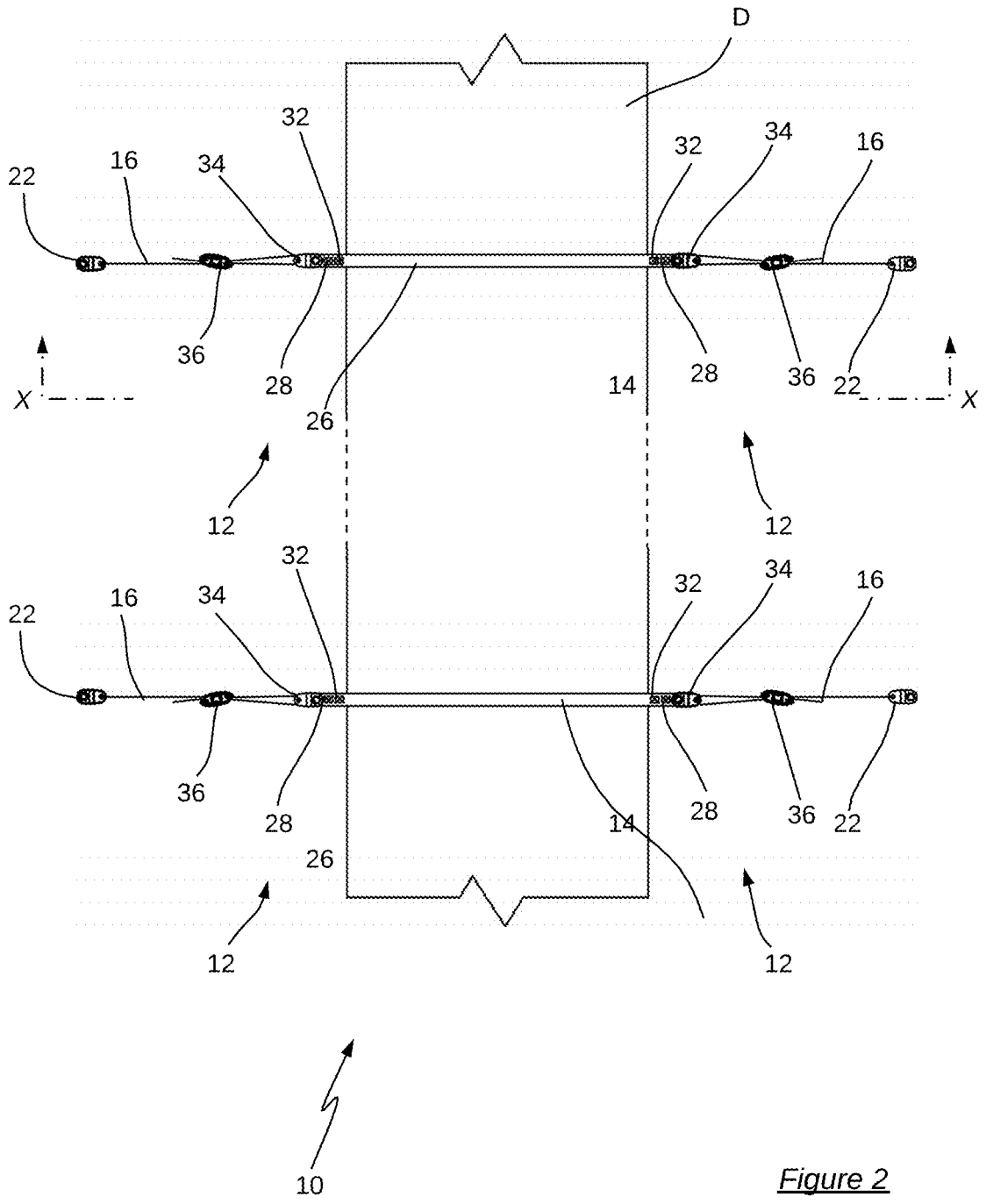
FIG. 2: is a bottom view of the system of FIG. 1.
Figure 3:
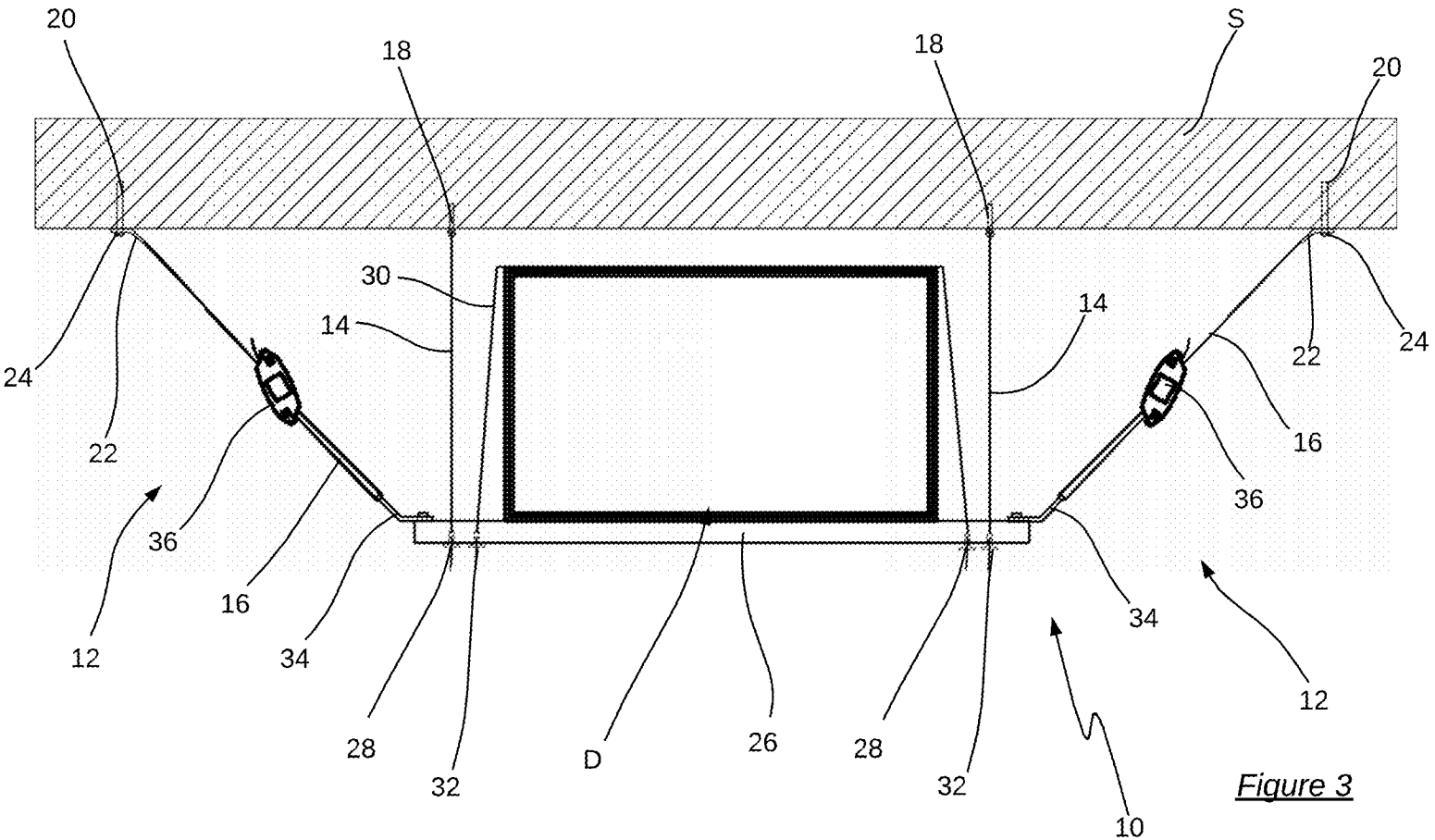
FIG. 3: is a vertical cross section of the system as viewed along the line X-X in FIG. 2.

FIGS. 1 to 3 show a system 10 for supporting a non-structural building component beneath a soffit S of a building, the system 10 being in accordance with a first embodiment. For clarity, the soffit S is not shown in FIGS. 1 and 2. In these Figures, the component is a section of duct D of a heating, ventilation and air conditioning (HVAC) system.

It will be appreciated that the invention is not limited to the forms of non-structural building component that are illustrated in the drawings. The system 10 can be used for any non-structural building component (or components) that are to be suspended within a building. By way of example only, the non-structural building components that system 10 can be used to support include ductwork, data and/or electrical cable tray, variable air volume (VAV) boxes, sprinkler pipe, junction boxes, lighting, plumbing, fan coil units, and pump units.

The system 10 has a plurality of suspension assemblies 12; in the example illustrated in FIG. 1, the system 10 has four suspension assemblies 12. Each of the suspension assemblies 12 has a first elongate non-rigid member 14, and a second elongate non-rigid member 16. In this example, the first and second elongate non-rigid members each include a cable. However, it will be understood that some alternative embodiments of the system could use elongate non-rigid members in the form of wire rope, plain wire, chain, non-metallic fibre(s), and the like. In some of these alternatives, the elongate non-rigid members can include a shroud portion that extends around one or more longitudinal tensile elements.

For simplicity of the following description the cable of the first elongate non-rigid member is hereinafter referred to as "first cable 14". Similarly, the cable of the second elongate non-rigid member is hereinafter referred to as "second cable 16".

The upper ends of the first and second cables 14, 16 are secured to structural portions of the building. As shown in FIG. 3, in this example the upper end of the first cable 14 is secured at an upper end to the soffit S at a first location. To this end, the first elongate non-rigid member includes a stud-type anchor 18 that is embedded in the soffit S, and the anchor 18 is swaged onto the end of first cable 14. The upper end of the second cable 16 is secured to the soffit S at a second location that is horizontally spaced from the first location. In this embodiment, the system 10 includes a threaded masonry bolt 20 that is embedded in the soffit S. The second elongate non-rigid member includes an eyelet 22 that is swaged onto the end of cable 16. The eyelet 22 is located on the shank of the masonry bolt 20, and retained by a 24.

In the embodiment illustrated in FIGS. 1 to 3, the system 10 includes support members that each include a strut 26 on which the duct D is supported. In each suspension assembly 12, the lower ends of the first and second cables 14, 16 are secured to one end of one of the struts 26. Further, the four suspension assemblies 12 are arranged in pairs, with each pair of suspension assemblies 12 being connected to a respective strut 26.

The first cables 14 are secured to the struts 26 by clamps 28. To this end, each of the first cables 14 passes through a hole in the strut 26, and one of the clamps 28 binds onto the cable 14 underneath the strut 26.

Each of the support members also includes a strap member with two ends that are attached to the respective strut 26. In this particular embodiment, each strap member is a flexible tie 30. The tie 30 extends around the duct D so as to restrain the duct D to the strut 26. In one example, the tie 30 can be a cable. As shown particularly in FIG. 3, each tie 30 is attached to the respective strut 26 by clamps 32 at each end. Each end of the tie 30 passes through a hole in the strut 26, and one of the clamps 32 binds onto the tie 30 underneath the strut 26.

In this particular embodiment, each of the clamps 28 includes a damper, so as to absorb shock loads in the respective first cable 14. Similarly, each of the clamps 32 includes a damper that absorbs shock loads in the respective tie 30. The inclusion of dampers aids in minimizing transfer of in-service vibration from the duct D to the structural components of the building.

Two eyelets 34 are attached to the ends of each strut 26. A cleat 36 is installed on each second cable 16 between the masonry bolt 20 and the respective eyelet 34. The free end of the second cable 16 extends through the eyelets 34, and then back through the cleat 36. In this way, the length of the portion of second cable 16 that is between the masonry bolt 20 and the respective eyelet 34 is adjustable.

As will be particularly evident from FIG. 3, the first cables 14 are oriented substantially vertically, and the second cables 16 are inclined to vertical. In the embodiment of FIGS. 1 to 3, the second cables 16 are inclined at approximately 45° to vertical. The system 10 is to be configured such that, when the building is in a stable condition, in each of the suspension assemblies 12, the tensile force in the first cable 14 is greater than the vertical component of the tensile force in the second cable 16. In this way, most, if not all, the weight of the duct D is carried by the first cables 14. In other words, when the building is in a stable condition, substantially all of the vertical load of the duct D is supported by the first cables 14.

For the purposes of this specification, it is to be understood that the expression "the building is in a stable condition" means that the building is substantially static and is not being subjected to vibration or shock loads. When an earthquake, seismic event, or similar event occurs, energy is transferred to the building through ground movement or pressure waves. This energy causes discernible movement and/or distortion (in other words, movement/distortion that can normally be felt by a person) of the structural part of the building can place the building in an "unstable" condition.

FIG. 2 shows a bottom view of the system 10. As will be appreciated, in this view the first cables 14 are obscured by the struts 26. In each of the two paired of suspension assemblies 12, the second cables 16 of the suspension assemblies 12 are parallel to a vertical plane in which the first cables 14 lie. Consequently, when the building is in a stable condition, the horizontal components of forces applied to the duct D by the two suspension assemblies 12 in each pair (which are the horizontal components of the tensile forces in the second cables 16) can be approximately equal and act in opposite directions. In this way, the sum of all horizontal components of forces applied to the duct D by the system 10 can be greatly reduced.

It will be appreciated that in some alternative embodiments, the strap member may be a substantially rigid component. In some further alternative embodiments, the entire support member may be made of a flexible material.

Figure 4:
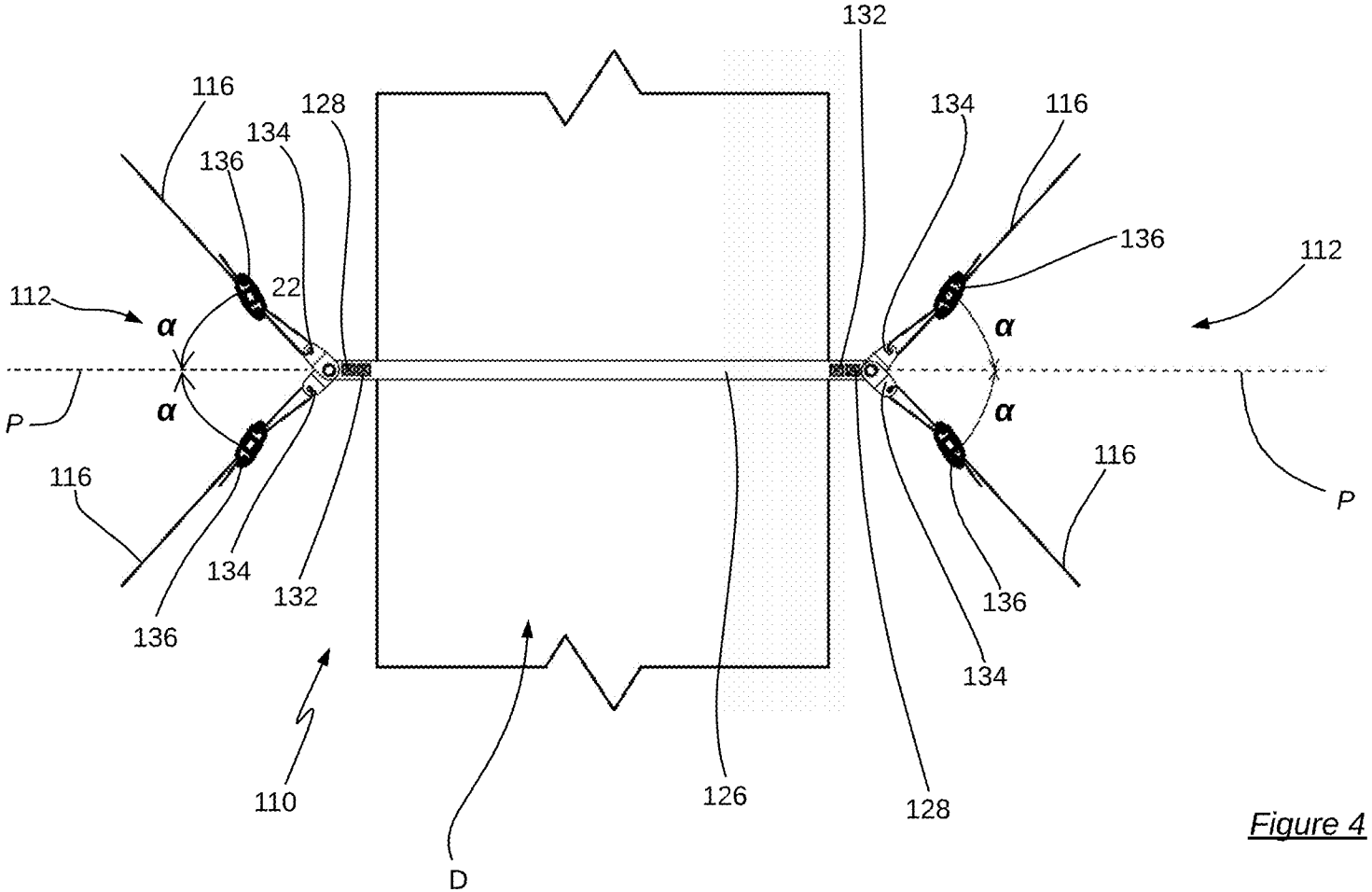
FIG. 4: is a bottom view of a system for supporting non-structural building components according to a second embodiment of the present invention.

FIG. 4 is a bottom view of a system 110 for supporting a non-structural building component beneath a soffit of a building, the system 110 being in accordance with a second embodiment. In FIG. 4, the component is a section of duct D of a HVAC system. The system 110 is substantially is substantially similar to the system 10 of FIGS. 1 to 3, and like components of the system 110 have the same reference numeral with the prefix "1".

In a similar manner to the system 10, the system 110 has the suspension assemblies 112 are arranged in pairs. As is evident from FIG. 4, each pair of suspension assemblies 112 is connected to a respective strut 126.

The system 110 differs from system 10 in that each suspension assembly 112 has two second cables 116. Within each suspension assembly 112, the upper ends of the second cables 116 are secured to structural portion of the building at spaced apart second locations. Further, in this embodiment, the lower ends of the two second cables 116 are secured to one another by a common fastener such as bolt 138. To this end, the system 110 has four eyelets 134 attached to the ends of each strut 126, with one of the second cables 116 passing through a respective eyelet 134. Thus, there are two eyelets 134 at secured to each end of the strut 126.

FIG. 4 includes a dashed line P that indicates the location of a vertical plane that is coincident with the first cables (which are not visible in FIG. 4). The vertical plane P is parallel to the viewing direction of FIG. 4, and thus only an edge of the plane P is visible. The attachment points of eyelets 134 to the strut 126 also lie in the vertical plane P.

In the system 110, the second locations, at which the upper ends (not shown) of the second cables 116 are secured to the structural component of the building, are selected such that the each second cable 116 has a complementary second cable 116 in the other suspension assembly 112 of the pair. Each second cable 116 and its complementary second cable 116 have an equal horizontal angular separation a from the vertical plane P, but extending in the opposite direction. In this way, it is likely that the horizontal components of tensile forces applied through the second cables 116 to the duct D are substantially equal and opposite.

In this particular embodiment, the horizontal angular separation a of each of the four second cables 116 from the vertical plane P is equal. In this embodiment, this angular separation is approximately 45°. This has the benefit of facilitating installing the system 10 such that the tensile loads in the second cables 116 is substantially equal when the building is in a stable condition.

Figure 5:
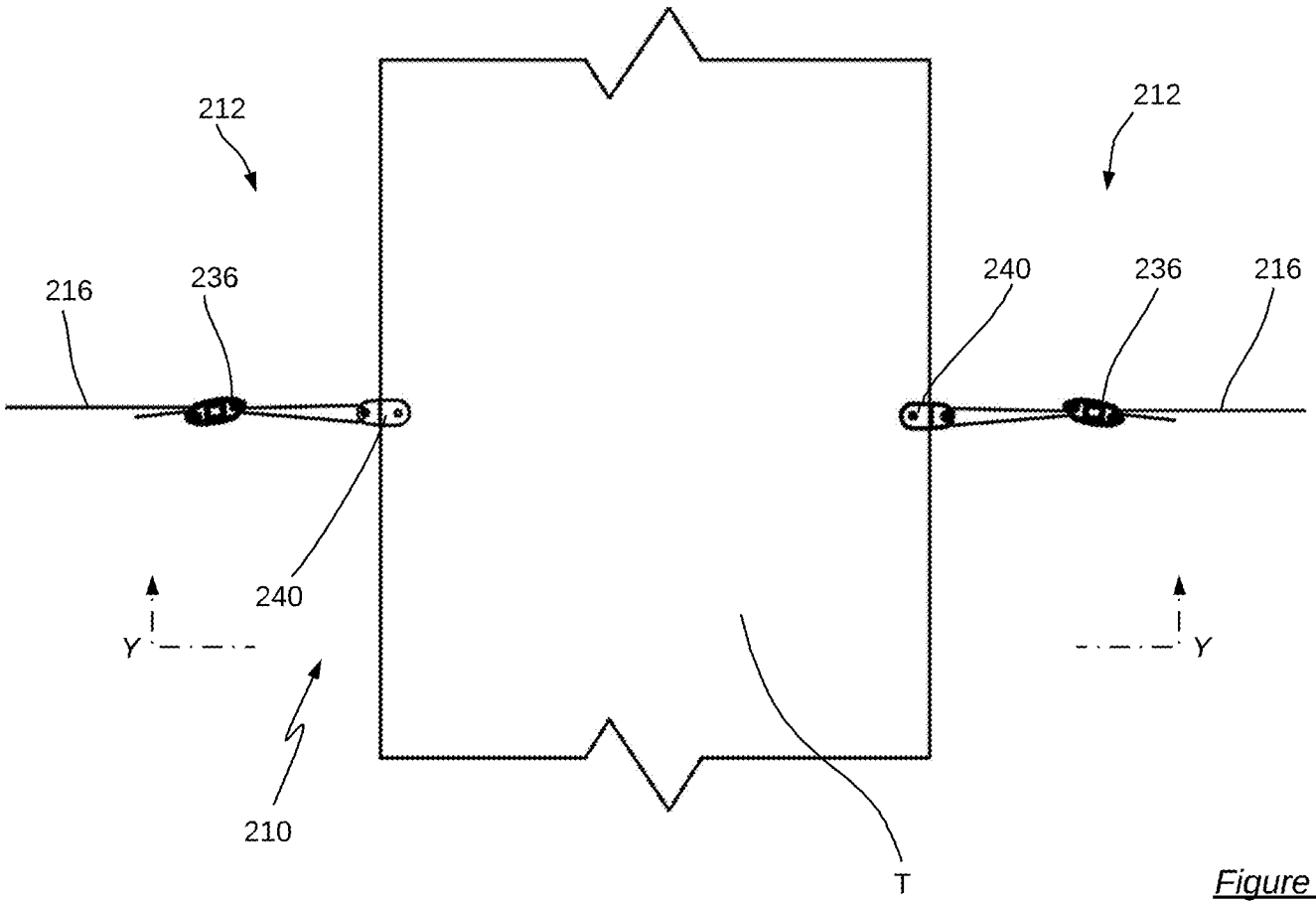
FIG. 5: is a bottom view a system for supporting non-structural building components according to a third embodiment of the present invention.
Figure 6:
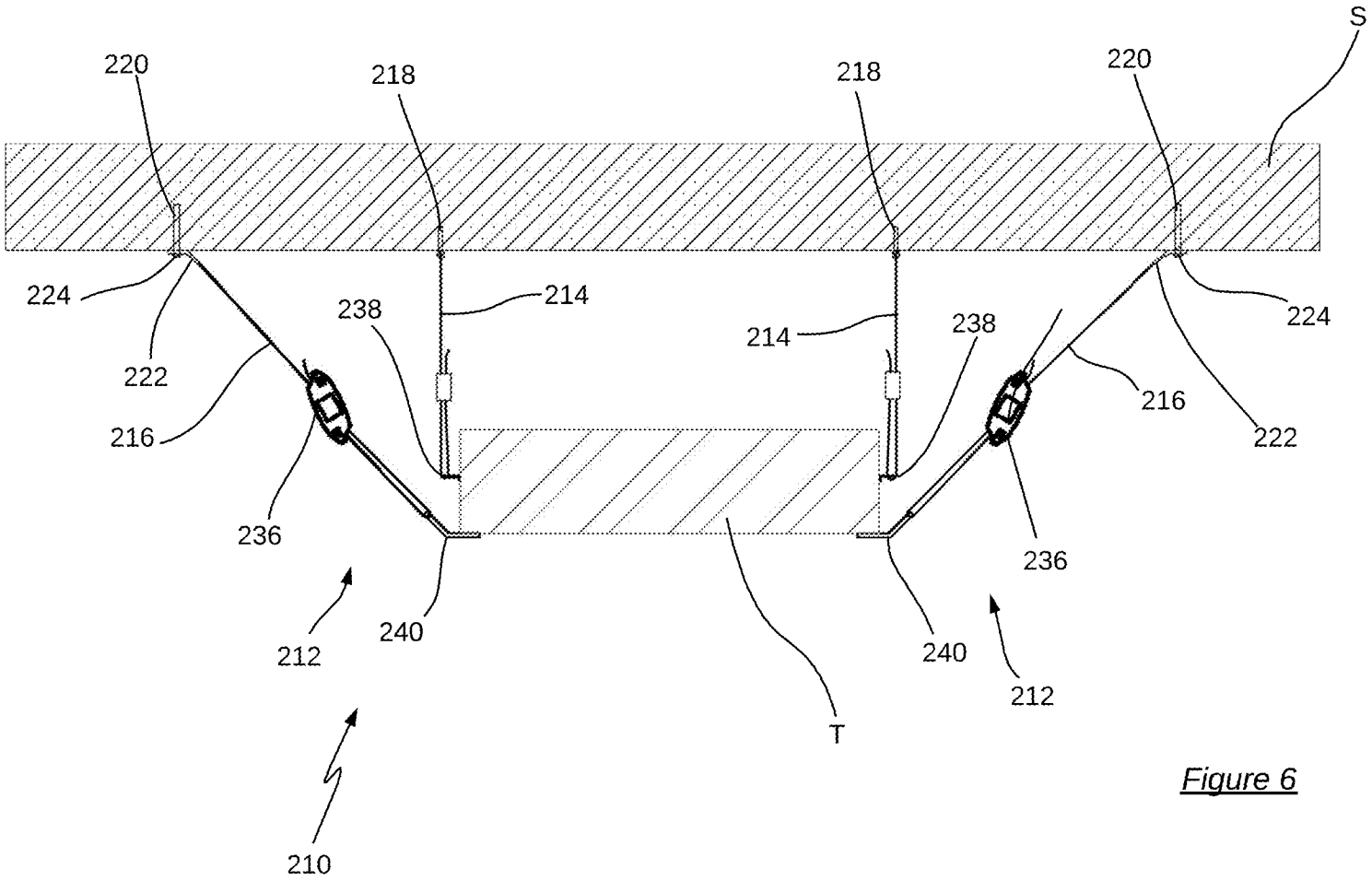
FIG. 6: is a vertical cross section of the system, as viewed along the line Y-Y in FIG. 5.

FIGS. 5 and 6 show a system 210 for supporting a non-structural building component beneath a soffit S of a building, the system 210 being in accordance with a third embodiment. In FIGS. 5 and 6, the component is a section of cable tray T in which data and/or electrical cables can be laid. The system 210 is substantially similar to the system 10 of FIGS. 1 to 3, and like components of the system 210 have the same reference numeral with the prefix "2".

The system 210 differs from system 10 in that it includes two first tether members 240 (shown in FIG. 6) to which the lower ends of the first cables 114 are secured. There is one first tether member 240 on each side of the cable tray T. The system 210 also has two second tether members 240 to which the lower ends of the second cables 216 are secured.

In this particular example, the two first tether members 240 are integral with the cable tray T, and the two second tether members 242 are separate components that are secured by fasteners to the tray T. Also in this particular example, the tether members 240, 242 are eyelets through which the respective first or second cable 214, 216 passes.

In this embodiment, in each suspension assembly 212, the free end of the first cable 214 is secured to the portion of the first cable 214 that extends between the respective anchor 218 and eyelet 240. To this end, a swagable clamp 244 can be used.

Figure 7:
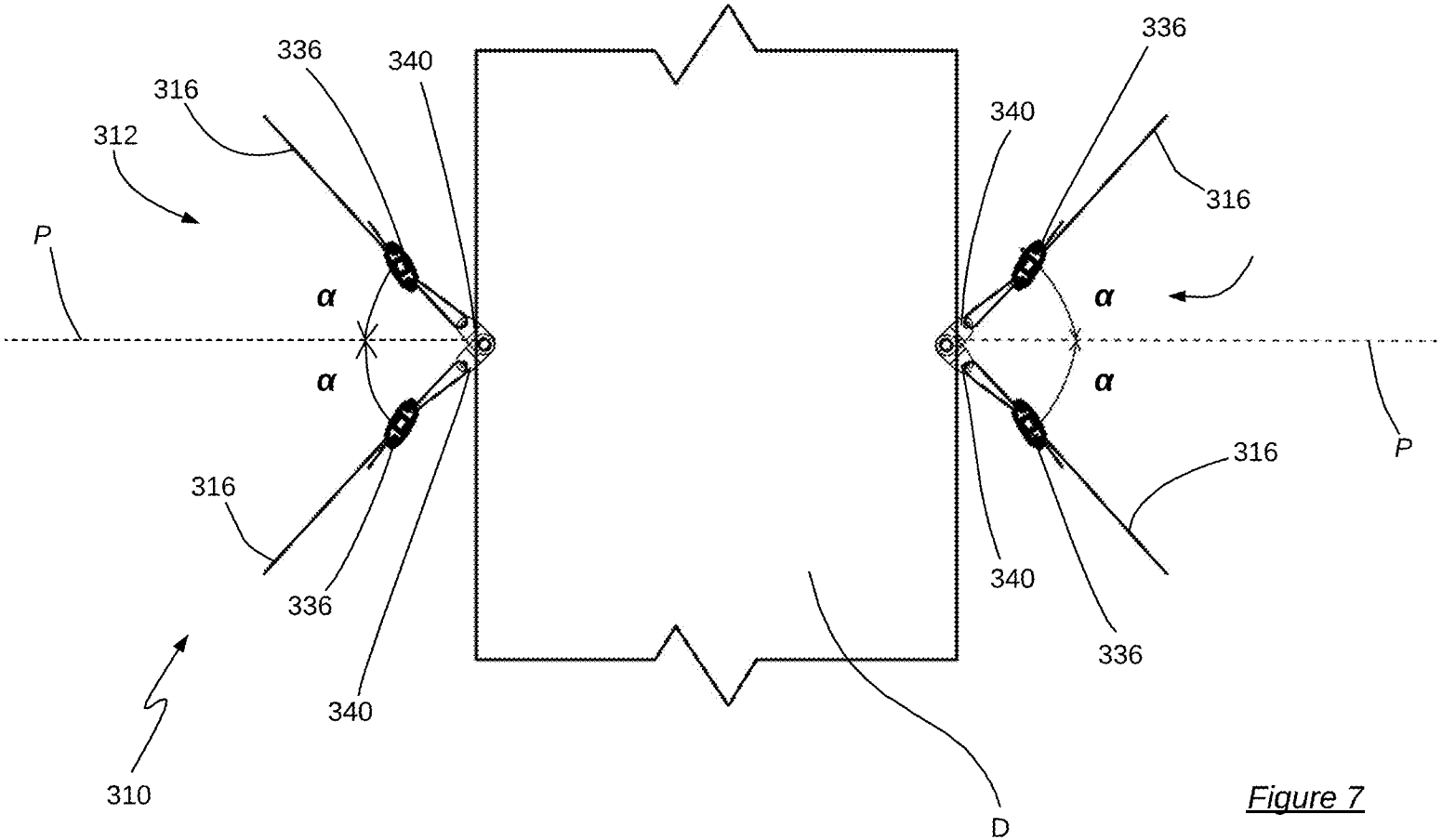
FIG. 7: is a bottom view of a system for supporting non-structural building components according to a fourth embodiment of the present invention.

FIG. 7 shows a system 310 for supporting a non-structural building component D beneath a soffit of a building, the system 310 being in accordance with a third embodiment. The system 310 is substantially is substantially similar to the system 10 of FIGS. 1 to 3, and like components of the system 310 have the same reference numeral with the prefix "3".

The system 310 is similar to the system 110 in that each suspension assembly 312 has two second cables 316.

The system 310 is also similar to the system 210 in that each suspension assembly 312 has two tether members 342 to which the lower ends of the respective two second cables 316 are secured. In each suspension member 312 the point at which the two tether members 342 are attached to the building component D at a common location. In some alternative embodiments, the second cables in each suspension assembly may be secured to a common tether member. However, it will be appreciated that some further alternative embodiments, each suspension assembly may be arranged with tether members that are spaced apart.

In FIG. 7, the location of a vertical plane that is coincident with the first cables (which are not visible in FIG. 7) is indicated by dashed line P. As will be appreciated, in this particular embodiment, the horizontal angular separation a of each of the four second cables 116 from the vertical plane P is equal. In this embodiment, this angular separation is approximately 45°.

FIGS. 8 to 13 illustrate steps in a method according to an embodiment of the invention, the method being for installing a system for supporting a non-structural building component (not shown in FIGS. 8 to 13) beneath a soffit of a building. This example method is described in reference to an embodiment that is substantially similar to the system of FIG. 1, with reference to the components of one of the two suspension assemblies 12, the strut 26, and the tie 30 and clamp 32. Accordingly, the reference numerals of FIGS. 1 to 3 have been adopted for like components of the system. In this example, the method includes the steps of securing a plurality of suspension assemblies to structural portions of the building, and securing the non-structural building component to the suspension assemblies.

More particularly, securing each suspension assembly to structural portions of the building can involve:

Step 1: securing the upper end of a first elongate non-rigid member to a structural portion of the building at a first location, the first location being selected such that, in the installed system, the first elongate non-rigid member is oriented substantially vertically;

Step 2: securing the upper end of at least one second elongate non-rigid member to a structural portion of the building at a second location that is spaced horizontally spaced from first location;

Step 3: securing the lower end of first elongate non-rigid member to one of: the non-structural building component, or a support member to which the non-structural building component is secured;

Step 4: securing the lower end of second elongate non-rigid member to one of: the non-structural building component, or a support member to which the non-structural building component is secured, whereby in the installed system, the second elongate non-rigid member is inclined to vertical; and Step 5: setting the tension in the second elongate non-rigid member such that the tensile force in the first elongate non-rigid member is greater than the vertical component of the tensile force in the second elongate non-rigid member.

Figure 8:
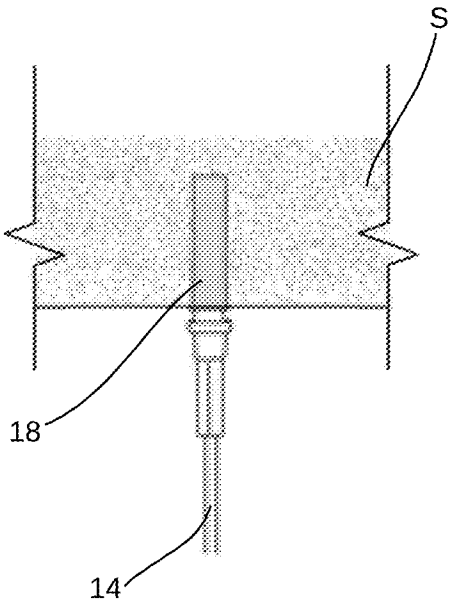

FIG. 8 illustrates Step 1, which in this embodiment more particularly involves embedding a stud-type anchor 18 in the soffit S, the anchor 18 is swaged onto the end of a first cable 14.

Figure 9:
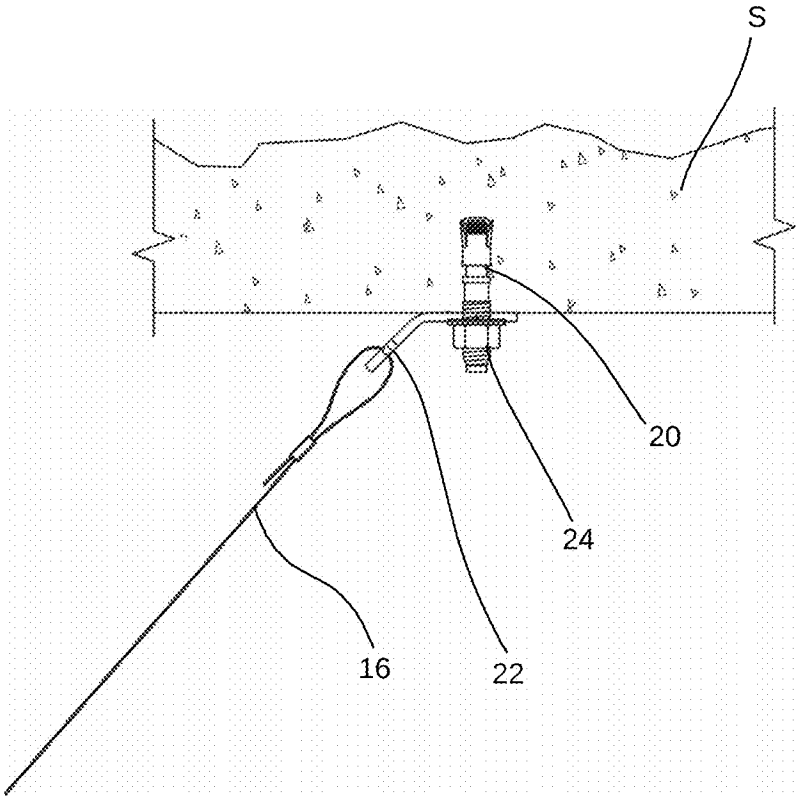
FIGS. 8 to 13: show steps in the installation of the system of FIG. 1.

FIG. 9 illustrates Step 2, which in this embodiment more particularly involves embedding a masonry bolt 20 in the soffit S, securing eyelet 22 to the bolt 20, and—in this example—passing the second cable 16 through a second hole in the eyelet and swaging the nearest free end to the cable 16 to form a loop.

Figure 10:
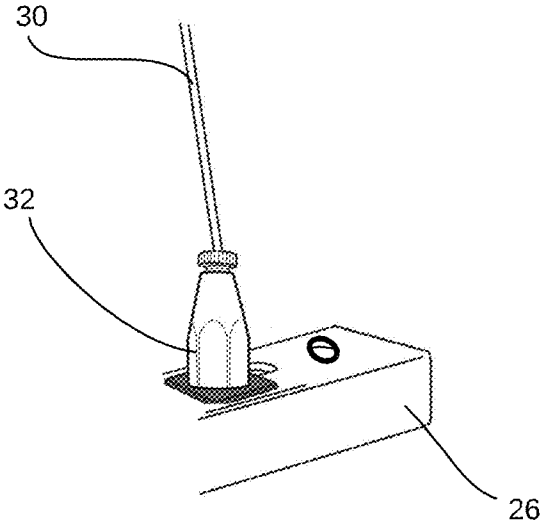

FIG. 10 illustrates a step of securing the building component to a strut 26, which involves passing the tie 30 over the building component and attaching the ends of the tie 30 to the strut 26 using one or more clamps 32.

Figure 11:
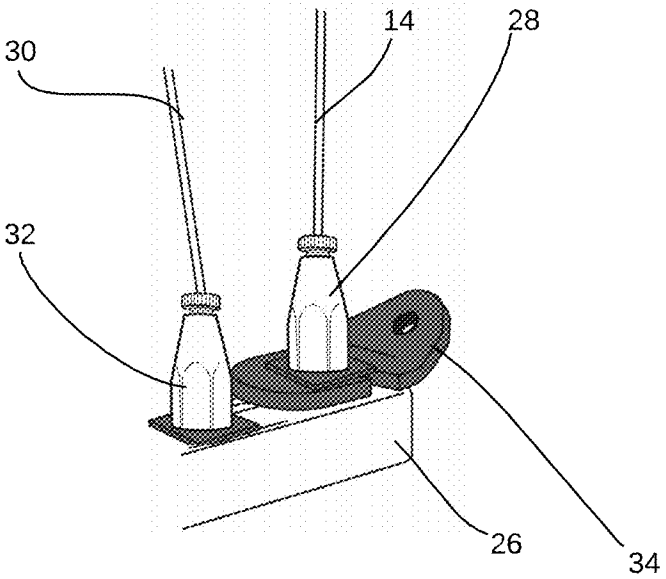

FIG. 11 illustrates Step 3, which in this embodiment more particularly involves securing the lower end of the first cable 14 to the strut 26 using a clamp 28. In this particular example, this process also involves securing eyelet 34 to the end of the strut 26.

Figure 13:
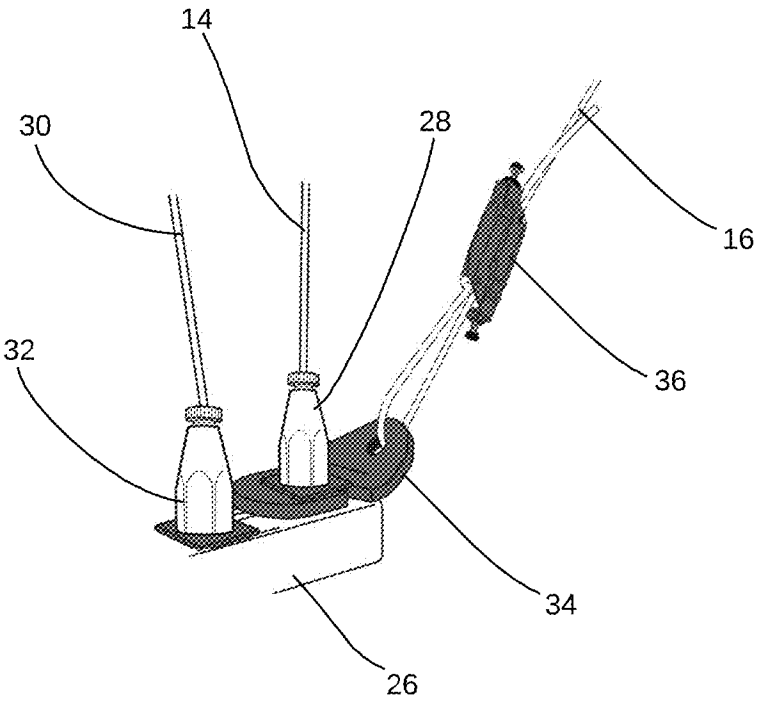
Figure 12:
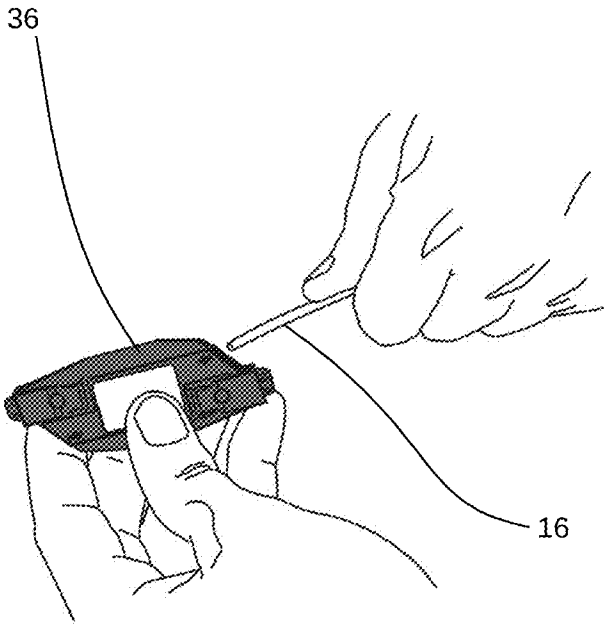

FIGS. 12 and 13 illustrate Step 4, which in this embodiment more particularly involves passing the second cable 16 through a first passage in cleat 36, through a hole in eyelet 34, and through a second passage in cleat 36, thereby forming a loop in the second cable 16.

Step 5 can involve pulling the free end of the second cable 16 shown in FIG. 13 to set the tension in the second cable 16. In at least some embodiments, this step may involve pulling on the free end of the second cable 16 to take up slack in the second cable 16. Alternatively or additionally, this step may involve pulling on the free end of the second cable 16 to "hand tight".

In this particular embodiment, the cleat 36 includes screws that can be tightened to lock the position of the second cable 16 in position within the passages of the cleat 36.

It will be appreciated that the above described steps are to be repeated for all like suspension assemblies. Adjustment and/or modification to these steps will be identifiable for alternative embodiments.

In the embodiments described in reference to the Figures, the upper ends of the first and second elongate non-rigid members are secured to a soffit of a building using anchors or fasteners that are embedded in the material of the soffit. It will be appreciated that other securing methods may be adopted. By way of non-limiting example, in some non-illustrated embodiments, the first and/or second elongate non-rigid members may be cable (or the like) that is looped or otherwise secured to a structural component (such as a joist, beam, or truss) of the building.

It will be appreciated that embodiments of the system may include suspension assemblies of different form that support a common non-structural building component.

Throughout this specification and the claims which follow, unless the context requires otherwise, the word "comprise", and variations such as "comprises" and "comprising", will be understood to imply the inclusion of a stated integer or step or group of integers or steps but not the exclusion of any other integer or step or group of integers or steps.

The reference in this specification to any prior publication (or information derived from it), or to any matter which is known, is not, and should not be taken as an acknowledgment or admission or any form of suggestion that that prior publication (or information derived from it) or known matter forms part of the common general knowledge in the field of endeavour to which this specification relates.

The invention claimed is:

1. A system for supporting a non-structural building component beneath a soffit of a building and providing seismic bracing to the non-structural building component, the system having a plurality of suspension assemblies, each comprising:

a first elongate non-rigid member that is secured at an upper end to a structural portion of the building at a first location, and at a lower end to the non-structural building component, or a support member to which the non-structural building component is secured;

at least one second elongate non-rigid member that is secured at a lower end to the non-structural building component, or the support member to which the non-structural building component is secured, and at an upper end to a structural portion of the building at a second location;

wherein, in each suspension assembly:

the first elongate non-rigid member is oriented substantially vertically, the second location is horizontally spaced from the first location, such that the second elongate non-rigid member is inclined to vertical, when the building is in a stable condition, a tensile force in the first elongate non-rigid member is greater than the vertical component of the tensile force in the second elongate non-rigid member, and substantially all of the vertical load of the non-structural building component is supported by the first elongate non-rigid member, and the first and second elongate non-rigid members are in the form of cable, wire rope, plain wire, or non-metallic fibre(s), wherein the suspension assemblies are arranged in one or more pairs of suspension assemblies, and wherein, within each pair of suspension assemblies and when the building is in a stable condition, the first elongate non-rigid members define a first vertical plane, and the lower ends of the second elongate non-rigid members are secured to the non-structural building component, at locations that are in the first vertical plane, or are secured to the support member at locations that are in the first vertical plane and without forming loops around a horizontal stringer of the support member.

2. The system according to claim 1, wherein each suspension assembly has two second elongate non-rigid members, and the upper ends of the two second elongate non-rigid members are secured to a structural portion of the building at spaced apart second locations.

3. The system according to claim 1, wherein each of the second elongate non-rigid member is provided with an adjuster that facilitates adjustment of the length of the respective second elongate non rigid member between upper and lower ends.

4. The system according to claim 1, wherein within each pair of suspension assemblies and when the building is in a stable condition;

one of the second elongate non-rigid members of a first suspension assembly of the respective pair of suspension assemblies lies in a second vertical plane, one of the second elongate non-rigid members of a second suspension assembly of the respective pair of suspension assemblies lies in a third vertical plane, and the second vertical plane is parallel to the third vertical plane.

5. The system according to claim 1, wherein each suspension assembly has a single second elongate non-rigid member, and wherein each pair of suspension assemblies is arranged so that tensile forces in the first elongate members, and the vertical components of the tensile forces in the second elongate non-rigid members are substantially coplanar.

6. The system according to claim 1, wherein each of the suspension assemblies includes one or more dampers that are each configured to inhibit transmission of vibration to the building.

7. The system according to claim 1, further comprising a plurality of support members to which the non-structural building component is secured, and wherein the lower ends of the first and second elongate non-rigid members in each pair of suspension assemblies are secured to a respective one of the support members.

8. The system according to claim 7, wherein each support member includes struts, each of which extends transversely across each of the non-structural building component, and opposing ends of the struts are each supported by a respective one of the pairs of the suspension assemblies.

9. The system according to claim 8, wherein each support member includes a strap member having two ends that are attached to the respective strut, and extends about the nonstructural building component so as to secure the non-structural building component to the strut.

10. The system according to claim 8, wherein the struts of each support member are positioned beneath the non-structural building component.

11. The system according to claim 10, wherein each support member includes a strap member having two ends that are attached to the respective strut, and extends about the nonstructural building component so as to secure the non-structural building component to the strut.

12. The system according to claim 8, wherein each support member furthers include one or more dampers that are each configured to inhibit transmission of vibration to the building.

13. The system according to claim 9, wherein each support member furthers include one or more dampers that are each configured to inhibit transmission of vibration to the building.

14. The system according to claim 1, further comprising tether members that are secured to the non-structural building component, and the lower ends of at least one of the first and second elongate non-rigid members in a respective one of the suspension assemblies is secured to each of the tether members.

15. The system according to claim 1, wherein both the first and second non-rigid members within each suspension assembly are formed of cable.

16. A method for installing a system for supporting a non-structural building component beneath a soffit of a building and providing seismic bracing to the nonstructural building component, the method comprising:

obtaining a plurality of suspension assemblies, each having a first elongate non-rigid member and at least one second elongate non-rigid member, wherein each of the first elongate non-rigid member and the second elongate non-rigid member include an upper end and a lower end, wherein each of the first and second elongate non-rigid members are in the form of cable, wire rope, plain wire, or non-metallic fibre(s), and wherein the suspension members are installed in one or more pairs of suspension assemblies, and for each pair of suspension assemblies the method involves:

securing the upper ends of the first elongate non-rigid members to a structural portion of the building at respective first locations that are selected such that, in an installed configuration of the system, the first elongate non-rigid members are oriented substantially vertically;

securing the upper ends of the second elongate non-rigid members to structural portions of the building at respective second locations that are horizontally spaced from the first locations;

securing the lower ends of the first elongate non-rigid members to the non-structural building component, or to a support member to which the non-structural building component is secured, such that when the building is in a stable condition, the first elongate non-rigid members define a first vertical plane; and securing the lower ends of the second elongate non-rigid members to the non-structural building component at locations that are in the first vertical plane, or to a support member to which the non-structural building component is secured, at locations that are in the first vertical plane and without forming loops around a horizontal stringer of the support member, whereby in an installed configuration of the system, the second elongate non-rigid members have an orientation that is inclined to vertical; and setting a tension in the second elongate non-rigid members such that, within each suspension assembly and when the building is in a stable condition, the tensile force in the first elongate non-rigid member is greater than the vertical component of tensile force in the second elongate non-rigid member, and substantially all of the vertical load of the non-structural building component is supported by the first elongate non-rigid member.

* * * * *